US007520628B1

(12) United States Patent
Sloan et al.

(10) Patent No.: US 7,520,628 B1
(45) Date of Patent: Apr. 21, 2009

(54) HIGH FLUX LED LAMP

(75) Inventors: Thomas C. Sloan, Santa Barbara, CA (US); Bruce Quaal, Ventura, CA (US)

(73) Assignee: SloanLED, Inc., Ventura, CA (US)

( * ) Notice: Subject to any disclaimer, the term of this patent is extended or adjusted under 35 U.S.C. 154(b) by 0 days.

(21) Appl. No.: 10/971,841

(22) Filed: Oct. 22, 2004

Related U.S. Application Data

(60) Provisional application No. 60/513,919, filed on Oct. 23, 2003.

(51) Int. Cl.
*F21V 33/00* (2006.01)

(52) U.S. Cl. ..... 362/101; 362/96; 362/294; 362/373

(58) Field of Classification Search ..... 362/101, 362/96, 294, 373; 257/100, 99, 98; 438/106, 438/112, 124–127, 25, 26
See application file for complete search history.

(56) References Cited

U.S. PATENT DOCUMENTS

| | | | | |
|---|---|---|---|---|
| 4,617,615 | A | 10/1986 | Eychaner | 362/216 |
| 4,644,450 | A * | 2/1987 | Caplin et al. | 362/147 |
| 5,051,875 | A | 9/1991 | Johnson | 362/101 |
| 5,122,936 | A | 6/1992 | Guthrie | 362/101 |
| 5,528,474 | A * | 6/1996 | Roney et al. | 362/545 |
| 5,890,794 | A * | 4/1999 | Abtahi et al. | 362/294 |
| 6,010,134 | A * | 1/2000 | Katoh | 277/615 |
| 6,404,131 | B1 * | 6/2002 | Kawano et al. | 315/82 |
| 6,595,675 | B2 * | 7/2003 | Dongo | 362/562 |
| 6,739,733 | B1 * | 5/2004 | Lamke et al. | 362/646 |
| 6,774,584 | B2 * | 8/2004 | Lys et al. | 315/362 |
| 2002/0176250 | A1 | 11/2002 | Bohler et al. | |
| 2003/0021115 | A1 | 1/2003 | Sloan et al. | |
| 2003/0063463 | A1 | 4/2003 | Sloan et al. | |
| 2003/0210546 | A1 | 11/2003 | Chin | |

* cited by examiner

*Primary Examiner*—Sandra L. O'Shea
*Assistant Examiner*—Gunyoung T. Lee
(74) *Attorney, Agent, or Firm*—Koppel, Patrick, Heybl & Dawson

(57) ABSTRACT

A high-power LED lamp comprises a cylindrical housing having a cavity and an open end with the housing made of a heat conductive material. One or more high power LEDs are mounted within the cavity such that at least some of the light from the LEDs is directed out the open end of the housing. An encapsulating material fills the cavity and surrounds the LEDs with the encapsulating material providing a waterproof covering over the LEDs and at least partially transmitting light from the LEDs out the opening. Heat from the LEDs conducts away from the LEDs and through the encapsulating material and the housing to dissipate in the ambient around the lamp.

31 Claims, 4 Drawing Sheets

FIG. 1
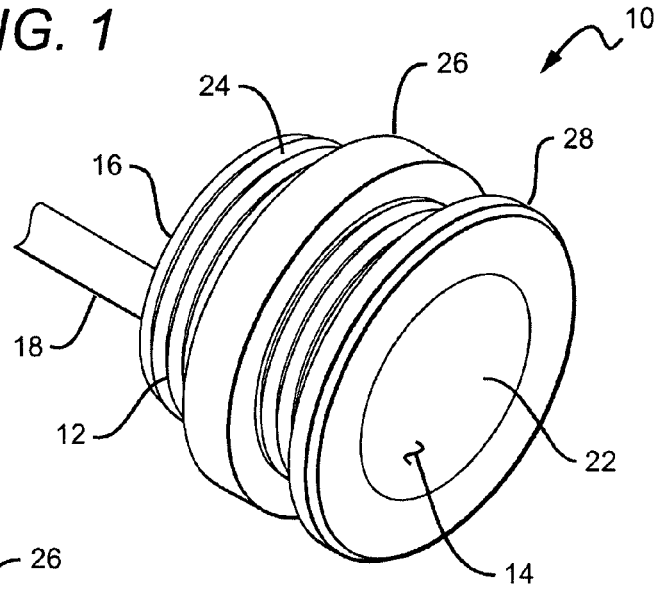
FIG. 2
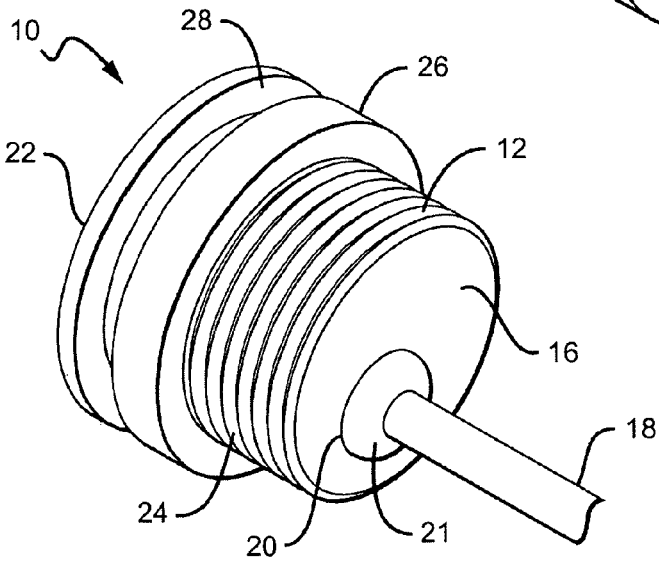
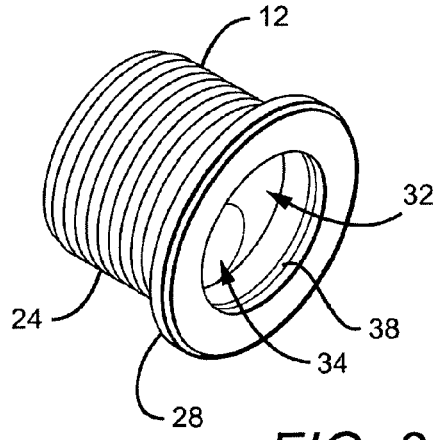
FIG. 3
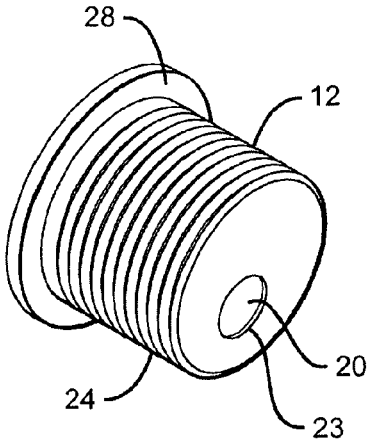
FIG. 4

FIG. 9
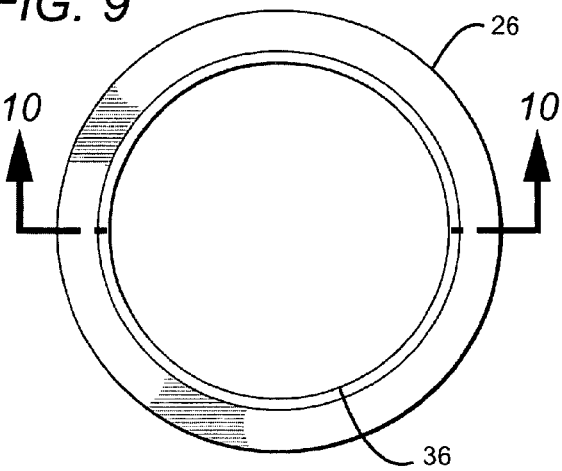
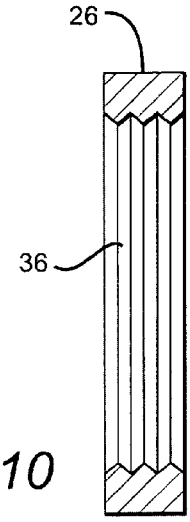
FIG. 10
FIG. 11
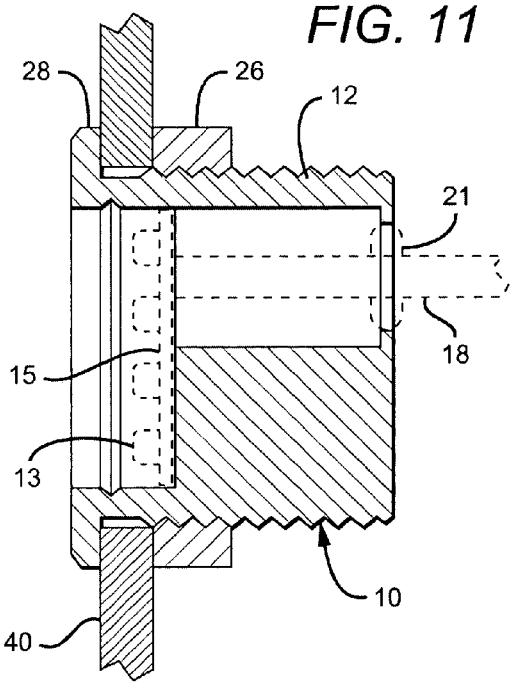
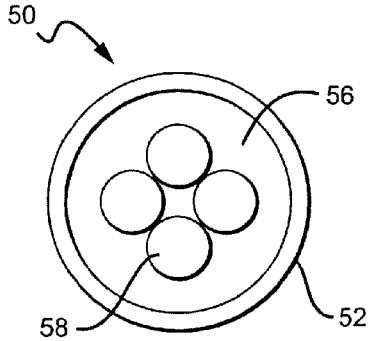
FIG. 14
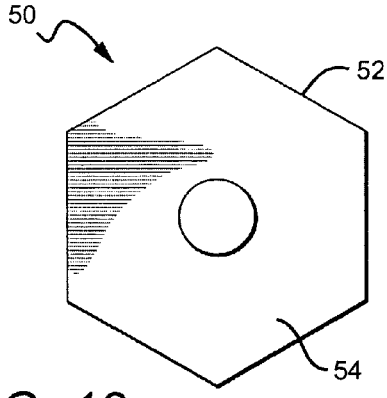
FIG. 13

FIG. 12
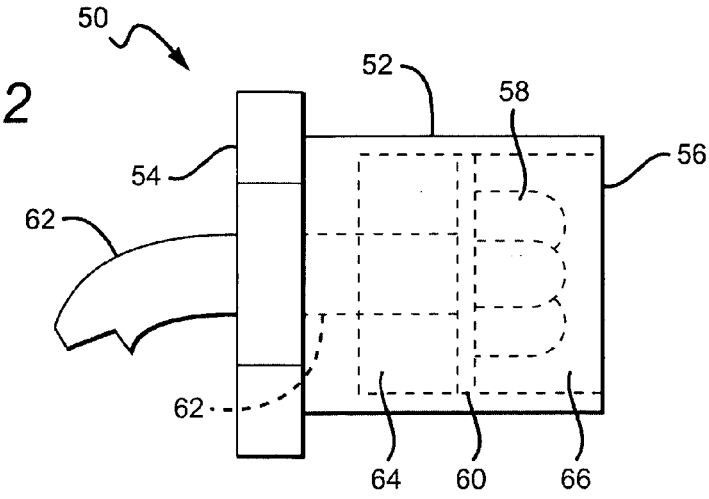
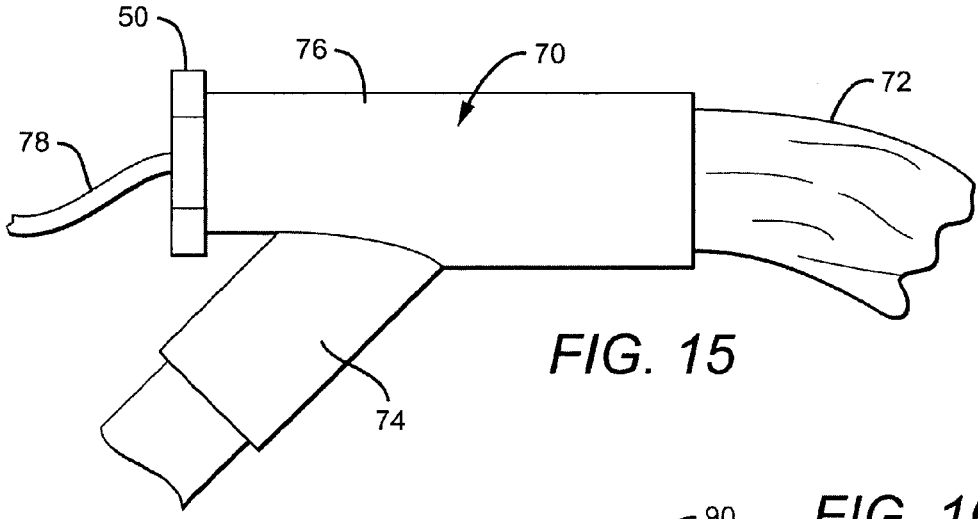
FIG. 15
FIG. 16
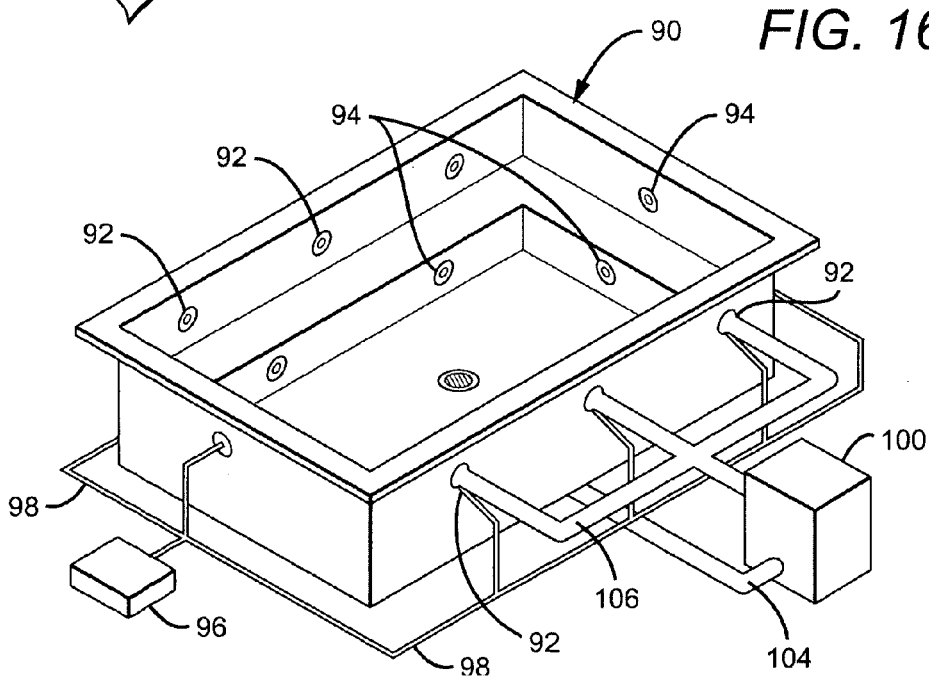

HIGH FLUX LED LAMP

This application claims the benefit of provisional application Ser. No. 60/513,919 to Sloan et al., which was filed on Oct. 23, 2003.

BACKGROUND OF THE INVENTION

1. Field of the Invention

This invention relates to lamps using high-power light emitting diodes as their light source.

2. Description of the Related Art

Pools and spas can be constructed with one or more underwater light sources that illuminate the water to make it both visually appealing and to allow for safe use of the pool or spa at night. Conventional lighting units are commonly mounted on the wall of the pool or spa, and comprise a watertight housing that contains an incandescent light source. On one side of the housing is an aperture for the power connection to the light source, and on the other side is a lens to scatter, direct, or focus the light from the light source. Each lighting unit requires its own mounting hole in the wall of pool or spa and its own power connection.

One example of a pool light is disclosed in U.S. Pat. No. 4,617,615 to Eychaner, which discloses a pool light having a circular fluorescent light bulb instead of an incandescent light source. The bulb is mounted in a fixture that can be retrofitted into or be used as an alternative to existing incandescent pool lights. Its primary advantage is that it is relatively low cost and allows for the replacement of high wattage incandescent bulbs with low wattage fluorescent bulbs.

U.S. Pat. No. 5,051,875 to Johnson also discloses a pool light mounted on a gunite pool wall or a vinyl liner pool wall. A double quartz halogen lamp is mounted in a sealed light source cavity with the lamp in a plane parallel to the plane of the pool wall on which the light is mounted. The pool light also includes openings that allow the liquid of the pool to circulate behind the light housing to cool the light.

Different devices in pools and spas have also been developed with integral lights to illuminate the water. For example, U.S. Pat. No. 5,122,936 to Guthrie, discloses a pool light that can be mounted over a pool's water extraction conduit. The light includes a watertight chamber that houses an electric light source, the chamber being held away from the pool's wall by an annular housing member that has several holes. Water passes through the annular housing holes, behind the chamber, and to the extraction conduit. The advantage of this light is that it can illuminate the pool while providing a protective cover over the extraction conduit.

Light emitting diodes (LEDs) are an important class of solid state devices that convert electric energy to light and generally comprise an active layer of semiconductor material sandwiched between two oppositely doped layers. When a bias is applied across the doped layers, holes and electrons are injected into the active layer where they recombine to generate light. Light is emitted omnidirectionally from the active layer and from all surfaces of the LED. Advances in the power and efficiency of LEDs has led to their use in devices that previously were the realm of incandescent bulbs, such as intersection signal lights and automobile lights. High power LEDs can provide high luminous flux, but they also can become very hot during operation. This can not only present a danger of burning, but can also reduce the life of the LEDs.

SUMMARY OF THE INVENTION

The present invention seeks to provide rugged, compact, reliable, easy to use, integrated, waterproof and thermally efficient lamps utilizing high-power LEDs as the light source. The lamps are particularly applicable for use in harsh environments, such as in reservoirs of water where the lamp can be safely used when in contact with the reservoir water.

One embodiment of a high-power LED lamp according to the present invention comprises a cylindrical housing having a cavity and an open end with the housing made of a heat conductive material. One or more high power LEDs are mounted within the cavity such that at least some of the light from the LEDs is directed out the open end of the housing. An encapsulating material fills the cavity and surrounds the LEDs with the encapsulating material providing a waterproof covering over the LEDs and at least partially transmitting light from the LEDs out the opening. Heat from the LEDs conducts away from the LEDs and through the encapsulating material and the housing to dissipate in the ambient around the lamp.

One embodiment of a pool/spa system according to the present invention comprises a reservoir capable of holding water and a plurality of water inlets mounted around the reservoir to provide a stream of water into the reservoir. A water pump system circulates water from the reservoir to the inlets. A high-power LED lamp is mounted within at least one of the water inlets to illuminate the stream of water provided into the reservoir. The LED lamp comprises a cylindrical housing having a cavity and an open end with the housing made of a heat conductive material. One or more high power LEDs are mounted within the cavity such that at least some of the light from the LEDs is directed out the open end of the housing and into the stream of water. An encapsulating material fills the cavity and surrounds the LEDs with the material providing a waterproof covering over the LEDs and at least partially transmitting light from the LEDs out the opening. Heat from the LEDs conducts away from the LEDs and through the encapsulating material and housing to dissipate.

Another embodiment of a pool/spa system according to the present invention comprises a reservoir capable of holding water and a plurality of light holes around said reservoir. A high-power LED lamp is mounted within at least one of the light holes to illuminate the water within the reservoir. The LED lamp comprises a cylindrical housing having a cavity and an open end, with the housing made of a heat conductive material. One or more high power LEDs are mounted within the cavity such that at least some of the light from said LEDs is directed out the open end of the housing and into the reservoir. An encapsulating material fills the cavity and surrounds the LEDs, with the material providing a waterproof covering over the LEDs and at least partially transmitting light from the LEDs out the opening. Heat from the LEDs conducts away from the LEDs and through the encapsulating material and the housing to dissipate.

These and other further features and advantages of the invention will be apparent to those skilled in the art from the following detailed description, taken together with the accompanying drawings.

BRIEF DESCRIPTION OF THE DRAWINGS

FIG. 1 is a front perspective view of one embodiment of LED lamp according to the present invention;

FIG. 2 is a rear perspective view of the LED lamp in FIG. 1;

FIG. 3 is a front perspective view of a housing for an LED lamp according to the present invention;

FIG. 4 is a rear perspective view of the housing in FIG. 3;

FIG. 9 is a front elevation view of a mounting nut according to the present invention;

FIG. 10 is a sectional view of the mounting nut in FIG. 9, taken along section lines 10-10 in FIG. 9;

FIG. 11 is a sectional view of an LED lamp mounted to a pool/spa wall using a mounting nut;

FIG. 12 is a side elevation view of another embodiment of an LED assembly according to the present invention;

FIG. 13 is an end elevation view of the LED assembly shown in FIG. 12;

FIG. 14 is another end elevation view of the LED assembly shown in FIG. 12;

FIG. 15 is side elevation view of one embodiment of an LED assembly according to the present invention mounted in a fixture; and FIG. 16 is a perspective view of a reservoir of water having LED lamps according to the present invention.

DESCRIPTION OF THE INVENTION

Figure 5:
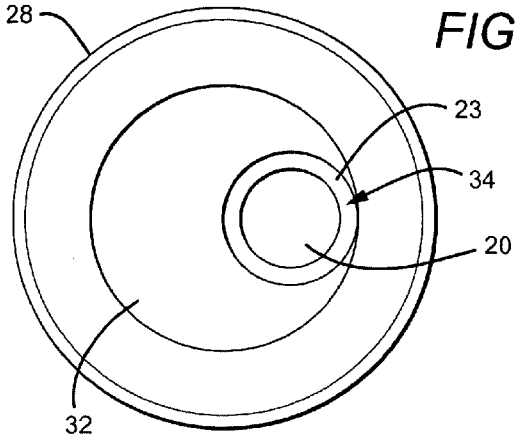
FIG. 5 is a front elevation view of the housing in FIG. 3.
Figure 6:
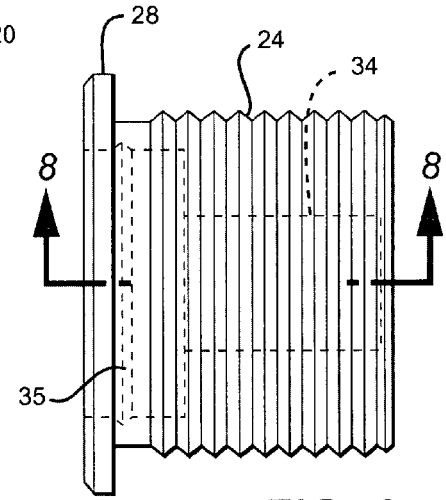
FIG. 6 is a side elevation view of the housing in FIG. 3.
Figure 7:
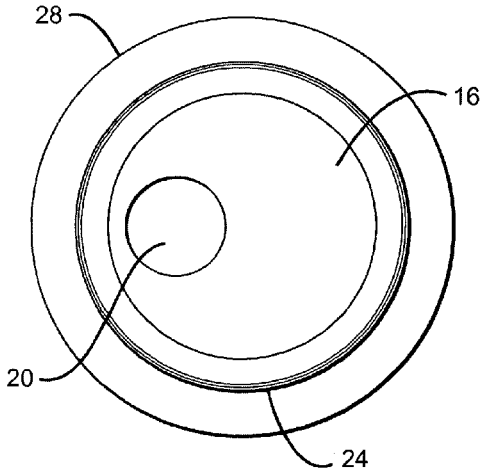
FIG. 7 is a rear elevation view of the housing in FIG. 3.

A lamp according to the present invention comprises an LED assembly having one or more high power LEDs arranged in a housing to provide a compact, rugged, heat sinking and waterproof LED lamp. LEDs are arranged within a cavity within a cylindrical housing such that when the LEDs illuminate the LED light is directed out a housing opening. The LEDs are encased in a material, such as an epoxy, that fills the cavity such that LEDs are held in a compact, rugged, heat sinking and waterproof housing.

High flux LEDs generate heat and the encasing material help radiate heat away from the LEDs to the surrounding ambient, which can be air and/or water. The encasing materials also allow the lamp to be used in harsh environments, such as in water, while still allowing the LEDs to radiate at a high luminous flux. This allows the LEDs to operate at a lower junction temperature, which in turn enables them to emit more light and last longer. The waterproof design also protects the LEDs and all electrical circuits and allows for use in underwater applications without the danger of electrical shock.

The LED assembly can be firmly mounted in many different locations, such as a hole in the wall of a pool/spa or integral with a pool/spa device such as a spa jet or outlet. The housing can use different types of metal that can mount into an external plastic housing while still providing some heat dissipation for the LEDs.

FIGS. 1 and 2 show one embodiment of an LED lamp 10 according to the present invention, which consists of a housing 12 that can be made of many different water impervious materials including but not limited to a metal, such as aluminum, or a plastic, such as ABS, PVC or CPVC. One or more internal high power LEDs 13 (shown in phantom in FIG. 8) are mounted within a cavity in the housing 12 and are surrounded by an encapsulating material 14. The LEDs 13 can be mounted in the housing 12 using many different methods and mechanisms with a preferred method being mounting the LEDs to a printed circuit board (PCB) 15 (also shown in phantom in FIG. 8) and then mounting the PCB within the assembly housing 12. The PCB 15 is mounted to the housing 12, preferably by a conductive bonding material such as a carbon epoxy, which creates an efficient thermal path for heat from the LEDs 13 to transmit to the housing 12 or the encapsulating material 14, and to the ambient around the lamp 10. The PCB 15 is also mounted such that it is electrically isolated from the housing 12 and also preferably mounted such that it is transverse to the housing's longitudinal axis. In an alternative embodiment, the LEDs can be mounted within the housing without a PCB and power can be provided to the LEDs by a direct wire connection.

A wire cable 18 is included that passes through a hole 20 in the bottom 16 of the housing 12 and is connected to the PCB 15 or directly to the LEDs 13. The cable 18 can comprise one or more wires that provide electrical connection to the lamp 10 and conduct power to the LEDs 13 for their illumination. Different types of cables can be used depending on the type and level power applied to the LEDs with a suitable wire being a UL listed PLTC (PVC Jacketed Cable). Some of the different types of power that can be applied to the LEDs include low voltage AC or DC power or typical line voltage (120V AC).

A watertight seal is provided between the cable 18 and the hole 20, with a suitable mechanism for providing the seal being a rubber grommet 21 that is included around the cable 18 and 21 fits into the hole 20 to provide a watertight seal at the hole 20. Other materials can be used to provide a watertight seal such as adhesives, epoxies and/or silicon.

The encapsulating material 14 fills the cavity in the housing 12 and is preferably an epoxy, although other materials can also be used. The epoxy can be optically clear or can have diffusing material, depending on the optical requirements of the particular LED lamp. In some embodiments (described below), a lens can be included over the front opening 22 of the housing for secondary optics, protection of the encapsulating material, or to give the LED assembly a finished look.

The housing 12 included a mechanism for mounting to a pool/spa or pool/spa device and is generally cylindrical and has threads 24 on its outside surface. In one embodiment according to the present invention the housing 12 is formed from a single piece of rigid thermally conductive material, such as copper or aluminum. Using a rigid material allows the LED assembly to be screwed into any hole having matching threads. The LED assembly can be used as a stand-alone light or it can be used in combination with existing light fixtures. For instance, the LED assembly can be mounted as a stand-alone device in a hole in a spa wall or spa device. Alternatively, it can be mounted to the back of an existing light housing and lens, with light from the LEDs shining out of the existing lens. In both these arrangements the LED assembly can be screwed into matching threads in the wall or existing light housing.

A mounting nut 26 can be included that has threads on its inside surface to mate with the housing threads 24. The mounting nut 26 allows the assembly 10 to be mounted to a larger body or fixture that does not have matching threads, such as an unthreaded hole in the wall of a spa. The spa hole should have a slightly larger diameter than the diameter of the housing 12 so that the housing 12 fits closely within the spa hole. The housing 12 has an axial flange 28 and when the LED assembly is inserted into the spa hole the flange 28 rests against the inside surface of the spa wall with the majority of the housing 12 being behind the spa wall. The mounting nut 26 is then turned on the housing threads 24 until it closes on the flange 28. A section of the spa wall is sandwiched between the nut 26 and flange 28 and the nut 26 is tightened to firmly hold the LED assembly 10 in the hole. A gasket, O-ring, or other sealant can be included between the flange 28 and the spa wall to provide a watertight seal.

FIGS. 3-8 show different views of the housing 12 showing its rear hole 20, threads 24 and flange 28. The housing 12 has a front axial cavity 32 that houses the LEDs 13 preferably on a PCB 15 (both shown in phantom in FIG. 8), such that light emits out the front of the housing 12, through the encapsulating material 14 shown in FIG. 1. A wire cable cavity 34 is included that is offset from the longitudinal axis of the housing 12 and passes from the back of the housing to the axial cavity 32. The opening of the wire cable cavity 34 at the back of the housing 12 corresponds to the hole 20. The cable 18 passes through the cavity 34 and into the axial cavity 32 where it is coupled to the LEDs (or PCB). The hole 20 has a lip 23 that is arranged such that the grommet 21 (shown in FIG. 2) can be mounted to the hole 20 on the lip 23 to provide the watertight seal with the cable 18.

Using a solid piece of conductive material for the housing 12 helps with heat management of the LED assembly 10. Heat from the LEDs radiates into the encapsulating material 24 and/or the PCB conductive bonding material and into the housing 12, where the heat radiates into the ambient around the lamp 10. The ambient can include air around part of the lamp 10 or water from the pool or spa contacting the lamp 10. This arrangement provides a heat conductive path to draw heat away from the LEDs 13 and to the surface of the housing 12. The heat at the surface of the housing more efficiently radiates into the ambient because of increased surface area compared to LEDs alone.

In the embodiments where cavity 34 is offset from the housing's longitudinal cavity, the hole 20 is also offset. This arrangement allows the PCB 15 to be mounted within the housing's axial cavity 32 with the LEDs aligned with the longitudinal axis of the body 12. By having the LEDs on the longitudinal axis, the connection points for the PCB can conveniently be off center or off longitudinal axis. For example, if the PCB is round or hex shaped and the LEDs are in the center of the PCB, the connection wires exit radially from the center. In some embodiments, high flux LEDs are mounted on aluminum substrate PCBs where the cathode of the LED is in thermal contact with the aluminum PCB. If the LED is centered, it is desirable to have the aluminum PCB under the cathode in contact with the aluminum housing 12. It is then desirable to have the wire 14 attached off center and not in the thermal path of the cathode to the housing.

FIGS. 9 and 10 show the mounting nut 26 which has a knurl outer grip surface, although the nut can have different shapes such as hexagonal or rounded and can have different grip surfaces. The nut 26 has threads 36 on its inside surface to mate with the housing threads 24. The size and diameter of the nut 26 is dependent upon the diameter of the housing outer (threaded) surface. The nut can be made of many different rigid materials such as plastics or metals.

As described above, all electrical connections are made to the LEDs through the wire 18 and the LEDs can be mounted on a PCB that is arranged within the housing's axial cavity 32. The PCB can also have additional electronics that form a circuit that accepts power from the cable 18 and drives the LEDs. Alternatively, the drive electronics can be separate from the LEDs as part of an external power supply that drives the LEDs directly through the cable 18.

Figure 8:
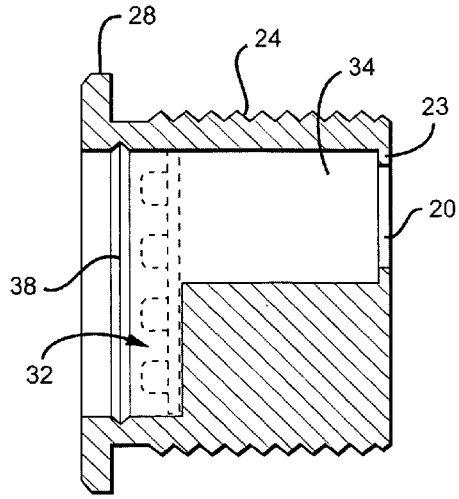
FIG. 8 is a sectional view of the housing in FIG. 3 taken along section lines 8-8 in FIG. 6.

The optical characteristics of the LED assembly can be changed by using different lenses that can be mounted in a groove 38 on the inside surface of the axial cavity 34 (as best shown in FIGS. 3 and 8). Coatings, reflectors or filters can also be incorporated into the housing 12. External optics may also be used to shape or diffuse the light. The lamp 10 can include different LEDs that alone or in combination emit different colors such as red, amber, yellow, green, blue and white, so that water within the pool/spa is illuminated by these different colors. In one embodiment according to the present invention the LEDs emit ultra-violet light (UV), and the water is UV illuminated.

In alternative embodiments of the LED assembly 10, the housing 12 can be made of more than one material. For instance, in the spa industry it may be undesirable to have some thermally conductive material (such as aluminum) exposed to the inside of the spa because of exposure to water and chemicals. Accordingly, the housing flange can be made of plastic, or can have a plastic cap, while the remainder of the housing is made of aluminum. In this arrangement little or no aluminum is exposed to the water and its chemicals.

FIG. 11 shows the lamp 10 mounted to a pool/spa wall 40 in a hole that is slightly larger than the diameter of the housing 12, with the majority of the lamp being behind the wall 40. The nut 26 is threaded onto the housing to sandwich a portion of the wall 40 between the nut 26 and the flange 28. A sealant, gasket or O-ring (not shown) can be included between the nut 26 and the wall 40 and/or the flange 28 and the wall 40 to provide a watertight seal between the lamp 10 and wall 40. The LEDs 13, PCB 15, cable 18 and grommet 21 are shown in phantom to illustrate one arrangement according to the present invention.

FIGS. 12-14 show another embodiment of an LED lamp 50 according to the present invention that comprises a housing 52 that can be made of many different materials, with a preferred material being PVC. In other embodiments housing 52 can be made of a metal such as copper or aluminum. The housing 52 is cylindrical down most of its length and has a base 54 at one end and an opening 56 at the other, with at least part of the housing 52 being hollow from the opening 56 toward the base 54. The base 54 is wider than the diameter of the cylindrical portion of the housing and can have different shapes, with a suitable shape as shown being hexagonal.

LEDs 58 are arranged within the hollow portion 57 of the housing 52 such that when they illuminate, the LED light is directed out the opening 56. The LEDs 58 can be mounted within the housing in many different ways, with the preferred mounting method being mounting the LEDs 58 to a PCB 60 that is then mounted within the housing 52. A preferred orientation for the PCB 60 is transverse to the housing's longitudinal axis with the tops of the LEDs 58 directed out the opening 56. The base 54 has an opening that passes through to the hollow section 57 of the housing 52 so that electrical conductors 62 can pass through the opening to provide power to the PCB 60 and LEDs 58.

A first encasing material 64 can be included in the housing's hollow portion 57 between the PCB 60 and the base of the hollow portion 57. The encasing material 64 can prevent water from leaking into the hollow section 57 and can also serve as a thermally conductive path to radiate heat away from the LEDs 58 and the PCB 60 to the housing 52, where it can radiate to the surrounding. Many different materials can be used for the first encasing material 64, with a preferred material being silicone. A second encasing material 66 can be included between the PCB 60 and its LEDs, and the housing opening 56 that is waterproof and rugged to protect the LEDs 58 and PCB 60 from water and damage, heat conductive to radiate heat away from the LEDs 58 and PCB 60, and optically clear to transmit light from the LEDs 58 out the opening 56. The second encasing material can also be made of many different materials, with a preferred material being epoxy.

The first and second encasing materials 64, 66 allow the LED assembly 50 to be used in harsh environments, such as in water, while still allowing the LEDs to radiate at a high luminous flux. High flux LEDs generate heat and the encasing material 64, 66 help radiate heat away from the LEDs and the PCB.

FIG. 15 shows one embodiment of a pool/spa feature or device with the LED lamp 50 according to the present invention mounted within it. The feature comprises a Y-shaped fixture 70 with the lamp 50 arranged to illuminate the water 72 passing through the first tube 74. The LED assembly 50 can be mounted in the second tube 76 using known mounting methods such as bonding with glues, although the housing can also be threaded to turn into threads in the second tube. Wire cable 78, for applying power to the LEDs, extends out of the second tube 76. Light from the assembly 50 passes down the second tube 76 where it is coupled into the stream of water passing down the first tube 74. Water emitting from the first tube gives the appearance of being illuminated and this arrangement is particularly adapted to illuminating water flowing out a spa jet or spa waterfall. It is understood that the lamp 50 can also be used with pool/spa jets, drains, inlets, etc. It is also understood that the LED assembly 50 can be used in many different ways to illuminate a stream of water and can be used in many different applications beyond illuminating a stream of water.

This arrangement also helps in radiating heat away from the LEDs 58 similar to the way the heat is radiated away from LEDs 13 in the lamp 10 above. Heat conducts into the encapsulating material 64, 66 and then into the housing 52. The heat can then radiate into the fixture 70 and the ambient around the fixture 70 and lamp 50.

FIG. 16 shows one embodiment of a reservoir 90 that can utilize one or more high power lamps according to the present invention. The reservoir comprises a plurality of water inlets 92, each of which can comprise a high power lamp according to the present invention to illuminate water entering the reservoir 90. The reservoir can also have a plurality of holes 94, each of which can contain a lamp according to the present invention to illuminate the water within the reservoir. A power supply 96 can supply power to the lamps along wire cables 98. Water from reservoir 90 is provided to pump 100 through the drain 102, which is connected through return water conduit 104 to pump 100. Water from pump 100 is provided back to reservoir 90 by conduits 106, where it flows into the inlets 92, and in turn into reservoir 90, completing the loop.

Although the present invention has been described in considerable detail with reference to certain preferred configurations thereof, other versions are possible. The LED lamps can be many different sizes, can contain many different components and can be used in many different applications. Therefore, the spirit and scope of the invention should not be limited to the preferred versions described above.

We claim:

1. A high-power light emitting diode (LED) lamp, comprising: a mounting mechanism to mount said lamp to a pool/spa or a pool/spa device;

a removable cylindrical housing having a cavity and an open end, a groove around a perimeter of an inside surface of said cavity proximate to said open end for mounting a replaceable lens therein, said housing made of a heat conductive material;

one or more high power LEDs disposed on a printed circuit board (PCB), said PCB mounted to said housing within said cavity using a thermally conductive bonding material such that at least some of the light from said LEDs is directed out said open end of said housing; and an encapsulating material substantially filling said cavity, said encapsulating material encasing said LEDs and portions of said PCB and contacting said inside surface of said cavity, said encapsulating material providing a waterproof covering over said LEDs and at least partially transmitting light from said LEDs out said opening, heat from said LEDs conducting away from said LEDs and through said encapsulating material and said housing to dissipate in the ambient around said lamp.

2. The lamp of claim 1, wherein said LEDs are mounted within said cavity by a conductive adhesive between said LEDs and said housing, said conductive adhesive also conducting heat away from said LEDs to said housing to dissipate in the ambient around said lamp.

3. The lamp of claim 2, wherein said conductive adhesive is a carbon epoxy.

4. The lamp of claim 1, wherein said LEDs operate at a lower temperature compared to the same LEDs not mounted within said housing and not covered by said encapsulating material.

5. The lamp of claim 1, wherein said housing has a hole opposite said open end, said hole arranged so that a wire can pass into said housing to provide electrical power to said LEDs.

6. The lamp of claim 5, further comprising a sealant to provide a watertight seal between said hole and said wire.

7. The lamp of claim 6, wherein said sealant comprises a grommet.

8. The lamp of claim 1, said thermally conductive bonding material also conducting heat away from said LEDs to said housing to dissipate in the ambient around said lamp.

9. The lamp of claim 1, said replaceable lens arranged to alter the characteristics of the light emitted by said LEDs.

10. The lamp of claim 1, wherein said mounting mechanism comprises threads on an outside surface of said housing arranged to mate with threads in said pool/spa or pool/spa device.

11. The lamp of claim 1, wherein said housing further comprises a flange and wherein said mounting mechanism comprises threads on an outside surface of said housing and a nut having threads to mate with said housing threads, said nut turning onto said housing to sandwich a portion of said pool/spa or pool/spa device between said nut and said flange.

12. The lamp of claim 1, wherein said housing fits closely within a hole in said pool/spa or pool/spa device, said mounting mechanism comprising bonding said housing within said hole.

13. The lamp of claim 1, wherein said housing is made of a metal or a plastic.

14. The lamp of claim 1, wherein said encapsulating material comprises an epoxy.

15. A pool/spa system, comprising:

a reservoir capable of holding water;

a plurality of water inlets mounted around said reservoir to provide a stream of water into said reservoir;

a water pump system that circulates water from said reservoir to said inlets;

a high-power light emitting diode (LED) lamp mounted within at least one of said water inlets to illuminate the stream of water provided into said reservoir, said LED lamp comprising;

a removable cylindrical housing having a cavity and an open end, a groove around a perimeter of an inside surface of said cavity proximate to said open end for mounting a replaceable lens therein, said housing made of a heat conductive material;

one or more high power LEDs disposed on a printed circuit board (PCB), said PCB mounted to said housing within said cavity using a thermally conductive bonding material such that at least some of the light from said LEDs is directed out said open end of said housing and into the stream of water;

an encapsulating material substantially filling said cavity, encasing said LEDs and portions of said PCB, and covering at least part of said inside surface of said cavity, said encapsulating material providing a waterproof covering over said LEDs and portions of said PCB and at least partially transmitting light from said LEDs out said opening, heat from said LEDs conducting away from said LEDs and through said encapsulating material and said housing to dissipate.

16. The system of claim 15, said thermally conductive bonding material also conducting heat away from said LEDs to said housing to dissipate in the ambient around said lamp.

17. The system of claim 15, wherein said LEDs operate at a lower temperature compared to the same LEDs not mounted within said housing and not covered by said encapsulating material.

18. The system of claim 15, wherein said housing has a hole opposite said open end, said hole arranged so that a wire can pass into said housing through said hole to provide electrical power to said LEDs.

19. The system of claim 15, said replaceable lens arranged to alter the characteristics of the light emitted by said LEDs.

20. The system of claim 15, further comprising a mounting mechanism to mount said lamp to said inlet.

21. The system of claim 20, wherein said mounting mechanism comprises threads on an outside surface of said housing arranged to mate with threads in said inlet.

22. The system of claim 20, wherein said housing fits closely within a hole in said inlet, said mounting mechanism comprising bonding said housing within said hole.

23. A pool/spa system, comprising:

a reservoir capable of holding water;

a plurality of light holes around said reservoir;

a high-power light emitting diode (LED) lamp mounted within at least one of said light holes to illuminate the water within said reservoir, said LED lamp comprising;

a removable cylindrical housing having a cavity and an open end, a groove around a perimeter of an inside surface of said cavity proximate to said open end for mounting a replaceable lens therein, said housing made of a heat conductive material;

one or more high power LEDs disposed on a printed circuit board (PCB), said PCB mounted to said housing within said cavity using a thermally conductive bonding material such that at least some of the light from said LEDs is directed out said open end of said housing and into said reservoir;

an encapsulating material substantially filling said cavity and encasing said LEDs and portions of said PCB, and covering at least part of said cavity, said encapsulating material providing a waterproof covering over said LEDs and portions of said PCB and at least partially transmitting light from said LEDs out said opening, heat from said LEDs conducting away from said LEDs and through said encapsulating material and said housing to dissipate.

24. The system of claim 23, said thermally conductive bonding material also conducting heat away from said LEDs to said housing to dissipate in the ambient around said lamp.

25. The system of claim 23, wherein said LEDs operate at a lower temperature compared to the same LEDs not mounted within said housing and not covered by said encapsulating material.

26. The system of claim 23, wherein said housing has a hole opposite said open end, said hole arranged so that a wire can pass into said housing through said hole to provide electrical power to said LEDs.

27. The system of claim 23, said replaceable lens arranged to alter the characteristics of the light emitted by said LEDs.

28. The system of claim 23, further comprising a mounting mechanism to mount said lamp within said at least one of said light holes.

29. The system of claim 28, wherein said mounting mechanism comprises threads on an outside surface of said housing arranged to mate with threads in.

30. The system of claim 28, wherein said housing fits closely within its said hole, said mounting mechanism comprising bonding said housing within said hole.

31. The system of claim 28, wherein said housing further comprises a flange and wherein said mounting mechanism comprises threads on an outside surface of said housing and a nut having threads to mate with said housing threads, said nut turning onto said housing to sandwich a portion of said reservoir between said nut and said flange.

* * * * *